US006772466B2

(12) United States Patent
Ziegler

(10) Patent No.: US 6,772,466 B2
(45) Date of Patent: Aug. 10, 2004

(54) CLEANING TOOL FOR CORRUGATED SURFACE

(76) Inventor: Peter W. Ziegler, 7223 S. Langston Rd., Seattle, WA (US) 98178

( * ) Notice: Subject to any disclaimer, the term of this patent is extended or adjusted under 35 U.S.C. 154(b) by 208 days.

(21) Appl. No.: 10/076,762

(22) Filed: Feb. 14, 2002

(65) Prior Publication Data

US 2003/0150074 A1 Aug. 14, 2003

(51) Int. Cl.[7] ..... A46B 9/00
(52) U.S. Cl. ..... 15/160; 15/DIG. 6
(58) Field of Search ..... D4/130, 132, 50; 15/160, 210.1, 221, 143.1

(56) References Cited

U.S. PATENT DOCUMENTS 5,707,454 A * 1/1998 Middleton ..... 134/6
6,446,295 B1 * 9/2002 Calabrese ..... 15/28
2002/0078902 A1 * 6/2002 Ehrmann ..... 119/625
2003/0074754 A1 * 4/2003 Holden ..... 15/160

FOREIGN PATENT DOCUMENTS

DE 3322355 A1 * 1/1985 ..... A46B/9/02
FR 2440229 A * 7/1980 ..... B08B/1/04

* cited by examiner

*Primary Examiner*—Mark Spisich
*Assistant Examiner*—Shay L Balsis
(74) *Attorney, Agent, or Firm*—Delbert J. Barnard

(57) ABSTRACT

A brush for cleaning corrugated surfaces has a multiplicity of bristles extending across the width of an elongated body. The bottom ends of the bristles form a virtual surface complementary to the corrugated surface. The bristles include a first set of bristles positioned to engage the ridges of the corrugated surface and a second set of bristles positioned to extend into the grooves of the corrugated surface. The first set of bristles have a first hardness, and the second set of bristles have a second hardness harder than the first hardness. This provides greater cleaning action in the hard to clean bottom surface portions of the grooves.

4 Claims, 3 Drawing Sheets

FIG. 4
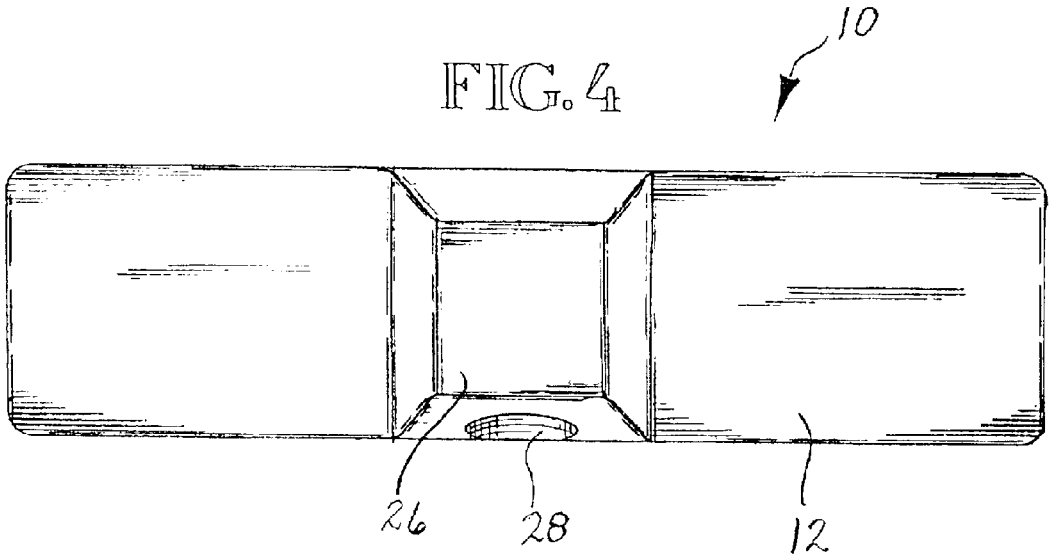
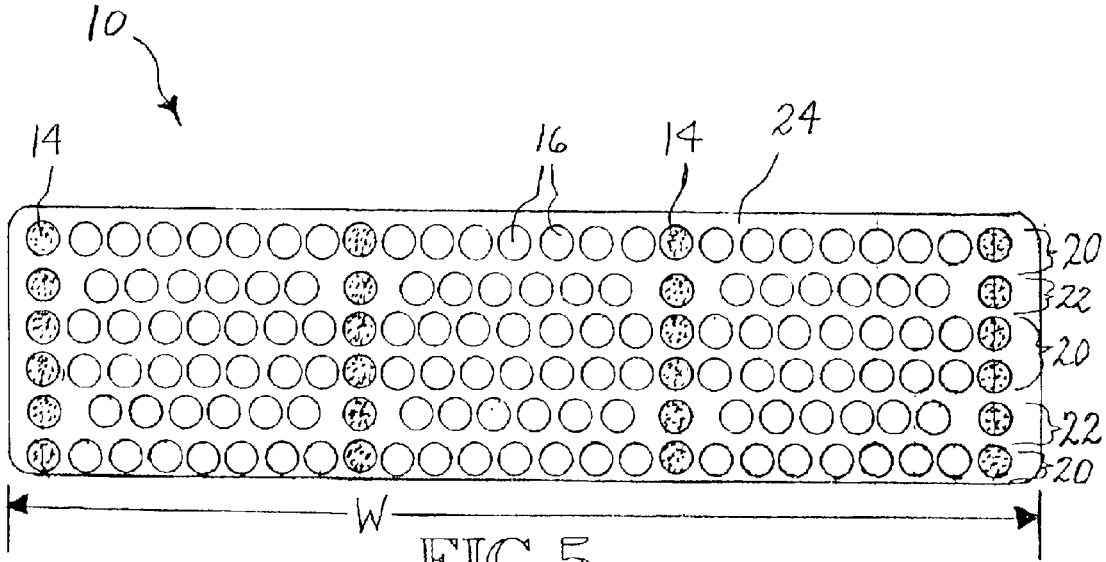
FIG. 5

CLEANING TOOL FOR CORRUGATED SURFACE

TECHNICAL FIELD

This invention relates to a brush for cleaning a corrugated surface and, more particularly, to such a brush that has bristles with bottom ends complementary to the corrugated surface and in which the bristles that engage the grooves of the surface are harder than those that engage the ridges.

BACKGROUND INFORMATION

Corrugated configurations are used in a number of different types of structures because of the enhanced strength that such configurations provide. A well-known problem associated with corrugated surfaces is that they are frequently difficult to clean. For example, corrugated sheets of fiber glass plastic are commonly used as roofs for structures such as decks attached to residential homes. The upper corrugated surfaces of these roofs tend to collect dirt and debris in the grooves of the corrugated surface. The accumulation of dirt and debris detracts both from the appearance of the roof and from the ability of the roof to transmit light to the area under the roof.

BRIEF SUMMARY OF THE INVENTION

The present invention addresses this problem by providing a cleaning tool for corrugated surfaces that efficiently and effectively provides greater cleaning action in the groove portions of the surface.

According to an aspect of the invention, a brush for cleaning a corrugated surface having a plurality of at least substantially parallel grooves spaced apart a predetermined distance by a plurality of ridges is provided. The brush comprises an elongated body having a width at least as great as the predetermined distance and a multiplicity of bristles. The bristles are carried by and extend downwardly from the body. The bristles are arranged in at least one row of bristles extending across the width. The bristles in the row have bottom ends complementary to the corrugated surface. They include a first set of bristles and a second set of bristles. The first set of bristles has bottom ends positioned to engage the ridges of the corrugated surface, and a first hardness. The second set of bristles is positioned to extend into the grooves of the corrugated surface to clean bottom surface portions of the grooves. The bristles in the second set have a second hardness harder than the first hardness of the first set of bristles.

In the preferred embodiment of the invention, the body of the brush has a bottom surface from which the bristles extend downwardly. The bottom surface is complementary to the corrugated surface. The bristles have a substantially uniform length from the bottom surface of the body to the bottom ends of the bristles.

Preferably, the bristles are arranged in a plurality of rows, and the bristles in the first sets of bristles in at least some adjacent rows are staggered along the width of the body. The body of the brush may include means for engaging a handle. The brush may further include a handle extending upwardly and rearwardly from the body.

These and other features and advantages of the invention will become apparent from the detailed description of the invention that follows.

BRIEF DESCRIPTION OF THE DRAWING

In the drawings, like element designations refer to like parts throughout, and:

FIG. 4 is a top plan view of the brush shown in FIGS. 1–3.

FIG. 5 is a bottom plan view of the brush shown in FIGS. 1–4.

DETAILED DESCRIPTION OF THE INVENTION

Figure 6:
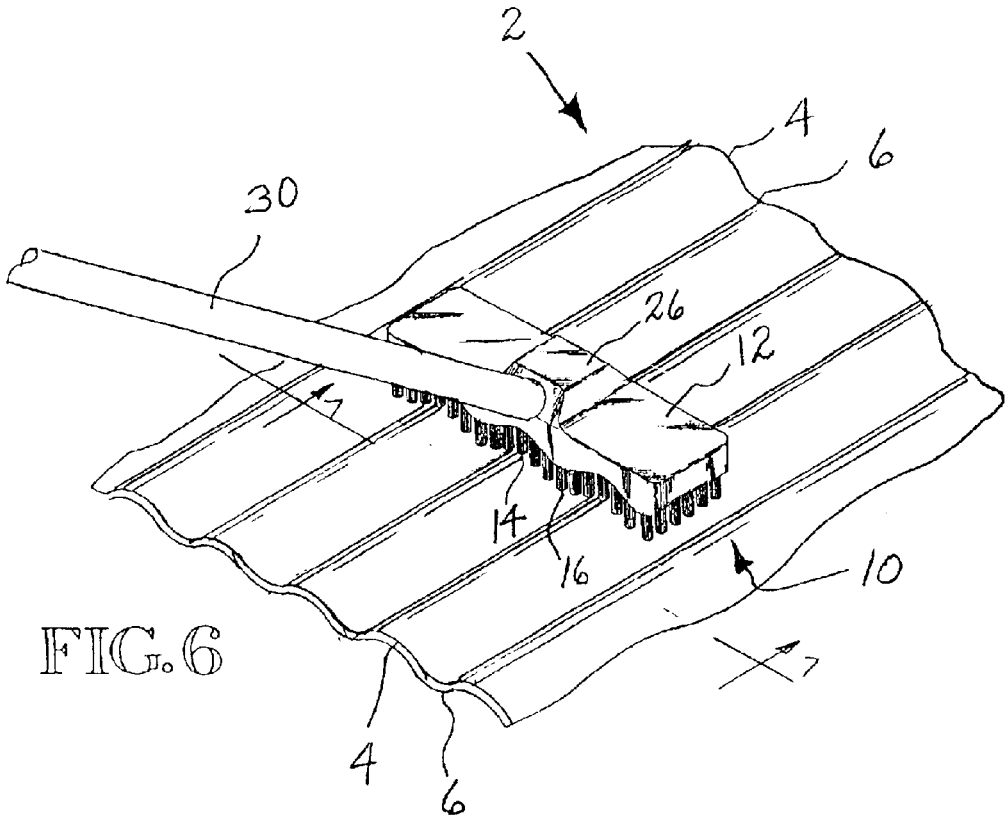
FIG. 6 is a pictorial view illustrating the use of the brush shown in FIGS. 1–5 to clean a corrugated surface.
Figure 7:
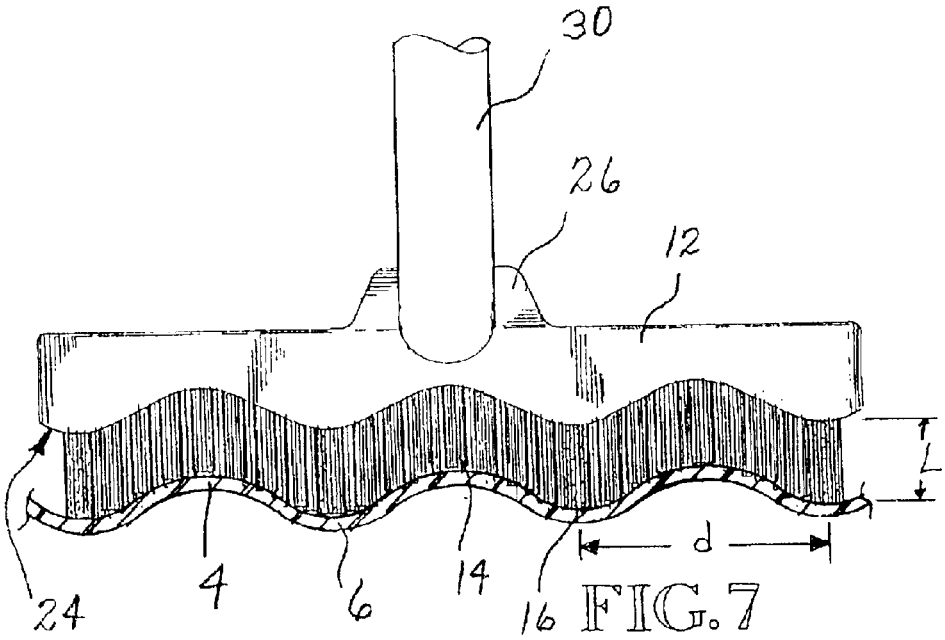
FIG. 7 is a sectional view taken along the line 7—7 of FIG. 6, with the brush shown in elevation.

The drawings show a brush 10 that is constructed in accordance with the preferred embodiment of the invention. FIGS. 6 and 7 illustrate the brush 10 being used to clean the upper corrugated surface of a corrugated sheet 2 having a plurality of at least substantially parallel grooves 6 spaced apart a predetermined distance by a plurality of ridges 4. The predetermined distance is indicated by the reference character d in FIG. 7. The sheet 2 may be made from various materials and used for various purposes. For example, the sheet 2 may be a corrugated sheet of plastic of the type commonly used as a roof on structures such as decks.

The brush 10 includes an elongated body 12 having a width W at least as great as the distance d. The width W is shown in FIG. 5. In the illustrated preferred embodiment, the width W is about three times as great as the distance d. The body 12 may be made of various materials, such as molded plastic.

The brush 10 also includes a multiplicity of bristles 14, 16 carried by and extending downwardly from the body 12. The bristles 14, 16 are arranged in at least one row 20, 22 extending across the width W. The bristles 14, 16 in the row 20, 22 have bottom ends 18 complementary to the corrugated surface to be cleaned by the brush 10. As used herein, the term "complementary" means that the imaginary surface defined by the bristle ends 18 is complementary to the corrugated surface to be cleaned so that, when the brush 10 is positioned with its bottom ends 18 engaging the corrugated surface, the ends 18 engage both the ridges 4 and the grooves 6 of the corrugated surface, as illustrated in FIGS. 6 and 7. It should be noted that corrugated structures such as corrugated roof sheeting have a standard configuration so that the brush 10 can be used to clean virtually any corrugated roof. Preferably, the bristles 14, 16 are arranged in an at least partially staggered configuration, such as that shown in FIG. 5, to avoid gaps in the cleaning of the corrugated sheet. In other words, to ensure that all portions of the corrugated surface are contacted by at least some of the bristles.

In each row 20, 22, the bristles 14, 16 include a first set of bristles 14 and a second set of bristles 16. The bristles in the first set 14 have bottom ends 18 positioned to engage the ridges 4 of the corrugated surface. The bristles 16 in the second set are positioned to extend into the grooves 6 of the corrugated surface to clean bottom surface portions of the grooves 6. The bristles 14 in the first set have a first hardness, and the bristles 16 in the second set have a second hardness harder than the first hardness. In the drawings, the bristles 16 in the second set have stippling to differentiate them from the bristles 14 in the first set. As can best be seen in FIGS. 2 and 7, the second set of bristles 16 corresponding to each groove 6 preferably includes at least one tuft of bristles 16. The illustrated preferred embodiment has a single tuft of bristles 16 corresponding to each groove 6. However, a greater number of tufts could also be provided. As used herein, the term "hardness" refers to the ability of the bristles to clean a surface. This ability is determined by factors such as physical hardness in the general sense, abrasiveness, and/or other characteristics that effect the cleaning action of the bristles when they are moved across a surface. The bristles 14, 16 may be natural or be made from various synthetic materials that provide the desired hardness.

Figure 1:
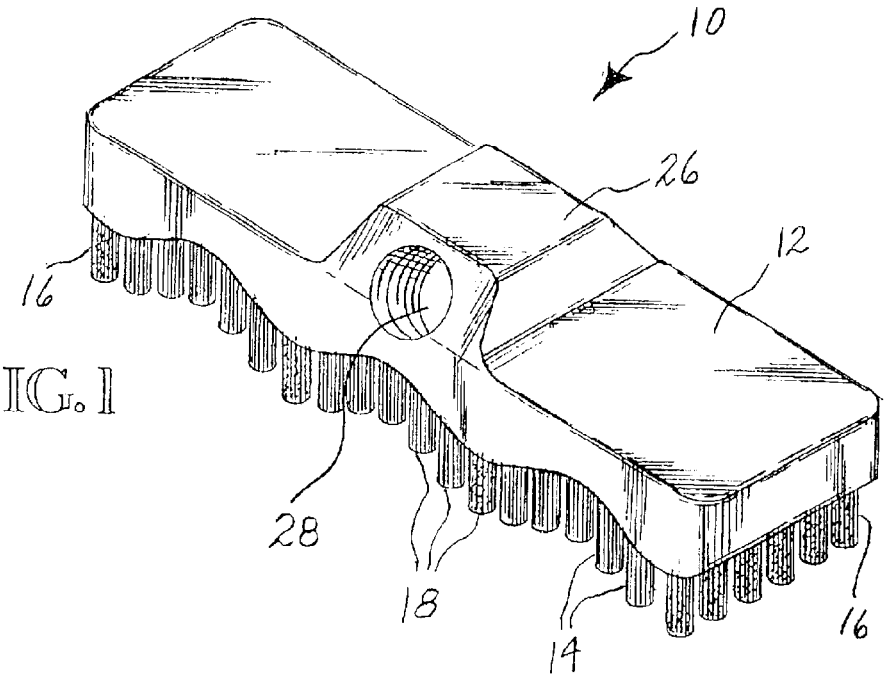
FIG. 1 is a pictorial view looking towards the top, rear, and one side of the preferred embodiment of the brush of the invention.
Figure 2:
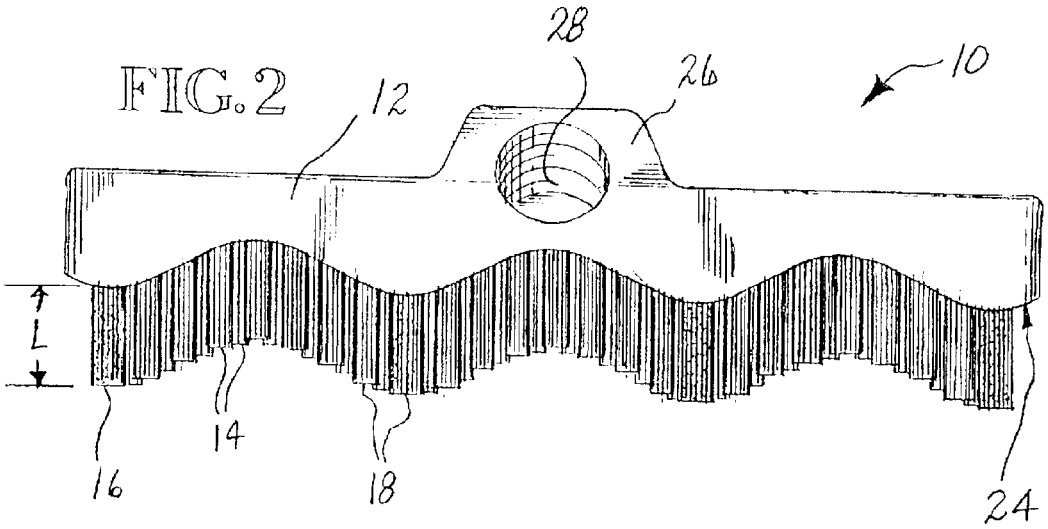
FIG. 2 is a rear elevational view of the brush shown in FIG. 1.
Figure 3:
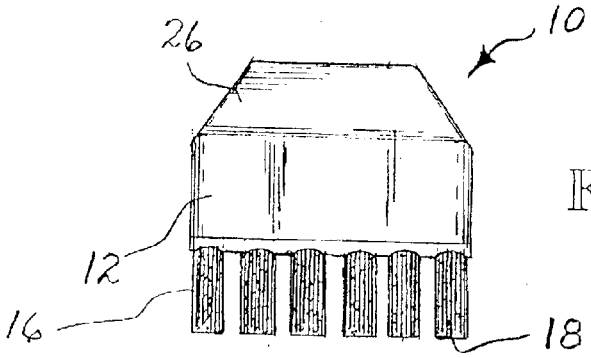
FIG. 3 is a side elevational view of the brush shown in FIGS. 1 and 2.

In the preferred embodiment, the bottom surface 24 of the brush body 12 is complementary to the corrugated surface to be cleaned. The bristles 14, 16 extend downwardly from the bottom surface and have a substantially uniform length L from the bottom surface 24 to their bottom ends 18. This length L is illustrated in FIGS. 2 and 7.

As described above, the configuration of the bristles 14, 16 is preferably at least partially staggered. Referring to FIG. 5, in the illustrated embodiment, there are six rows 20, 22 of bristles extending across the width W of the body 12. The front row, rear row, and two middle rows are designated by the reference numeral 20. In these rows 20, the tufts of bristles 14, 16 are arranged in a line and are substantially equally spaced. In the two remaining rows 22, the spacing between tufts in the first sets of bristles 14 and tufts in the second sets of bristles 16 is greater than the spacing in the rows 20 and the spacing between adjacent tufts in the first sets of bristles 14 in the rows 22. This results in the tufts of bristles in the first sets 14 of the rows 22 being staggered relative to the tufts of the first sets of bristles 14 in the rows 20. The staggering contributes to the desired goal of engaging all areas of the surface to be cleaned.

A brush constructed according to the invention could be used by directly grasping the body of the brush. However, the brush is preferably used by grasping a handle carried by the body. Such a handle could be formed as an integral part of the body. However, for ease of manufacture, the handle is preferably formed separately and attached to the body 12. In such case, the body 12 includes means for engaging the handle. In the illustrated preferred embodiment, the body 12 of the brush 10 has a projection 26 on its upper surface. A threaded opening 28 is formed in the projection 26. The handle 30 has corresponding threads (not shown) for attaching the handle 30 to the body 12. This type of arrangement is a known means for providing for the engagement of a brush or broom body by a handle. In accordance with the invention other means of engagement could also be used. As best seen in FIG. 6, when the handle 30 is attached to the body 12 and the brush 10 is in use, the handle 30 extends upwardly and rearwardly from the body 12. As used herein, the terms "upwardly", "rearwardly", "downwardly", and the like refer to the use orientation illustrated in FIG. 6.

Although the preferred embodiment of the invention has been illustrated and described herein, it is intended to be understood by those skilled in the art that various modifications and omissions in form and detail may be made without departing from the spirit and scope of the invention as defined by the following claims.

What is claimed is:

1. A brush for cleaning a corrugated surface formed by parallel ridges and valleys, said brush comprising:

a brush body;

a plurality of bristles carried by and extending downwardly from said brush body, said bristles having undulating lower ends that form parallel ridges and valleys complementary to the parallel ridges and valleys of the corrugated surface;

said bristles including valley bristles having lower ends positioned to engage the ridges on the corrugated surface, and ridge bristles having lower ends positioned to extend into the valleys of the corrugated surface;

said valley bristles including bristles of a first hardness;

said ridge bristles including bristles of a second hardness that is harder than the first hardness; and wherein in use the bristles of the brush are movable along the parallel ridges and valleys of the corrugated surface with the parallel ridges and valleys formed by the lower ends of the bristles in contact with the parallel ridges and valleys of the corrugated surface.

2. The brush of claim 1, wherein said brush body has an undulating bottom surface from which said bristles extend downwardly, said bottom surface being complementary to the corrugated surface, and said bristles having a substantially uniform length from said bottom surface of said brush body to said bottom ends of said bristles.

3. The brush of claim 1, wherein said brush body includes means for engaging a handle.

4. The brush of claim 1, further comprising a handle extending upwardly and rearwardly from said brush body.

* * * * *